US006644412B2

(12) United States Patent
Bode et al.

(10) Patent No.: US 6,644,412 B2
(45) Date of Patent: Nov. 11, 2003

(54) FLOW CONTROL APPARATUS FOR USE IN A WELLBORE

(75) Inventors: Jeffrey Bode, The Woodlands, TX (US); Craig Fishbeck, Houston, TX (US); Tom Hill, Kingwood, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/844,748

(22) Filed: Apr. 25, 2001

(65) Prior Publication Data

US 2002/0157837 A1 Oct. 31, 2002

(51) Int. Cl.[7] ..... E21B 43/08
(52) U.S. Cl. ..... 166/373; 166/233; 166/236
(58) Field of Search ..... 166/370, 373, 166/233, 236, 278, 228, 51, 133, 242.1, 305.1

(56) References Cited

U.S. PATENT DOCUMENTS

| | | | | |
|---|---|---|---|---|
| 3,739,845 A | 6/1973 | Berry et al. | ..... | 166/65 R |
| 3,951,338 A | 4/1976 | Genna | ..... | 236/93 A |

(List continued on next page.)

FOREIGN PATENT DOCUMENTS

| | | | |
|---|---|---|---|
| EP | 0 999 341 | 5/2000 | ..... E21B/33/124 |
| EP | 1 055 797 | 11/2000 | ..... E21B/21/10 |
| GB | 2 339 226 | 1/2000 | ..... E21B/34/10 |
| WO | WO 98/36155 | 8/1998 | ..... E21B/43/32 |
| WO | WO 00/29715 | 5/2000 | ..... E21B/34/10 |
| WO | WO 00/45031 | 8/2000 | |
| WO | WO 00/47867 | 8/2000 | ..... E21B/43/08 |

OTHER PUBLICATIONS

PCT International Search Report for International Appn. PCT/US00/02420 mailed May 11, 2000.

Product Announcement from Baker Oil Tools for new "EQUALIZER" system, Apr. 15, 1998.

U.S. patent application Ser. No. 09/685,368, Bode et al., filed Oct. 10, 2000.

PCT International Search Report from International Application No. PCT/GB02/01763, Dated Aug. 6, 2002.

PCT Written Opinion, International Application No. PCT/GB02/01763, dated Dec. 12, 2002.

*Primary Examiner*—Frank S. Tsay
(74) *Attorney, Agent, or Firm*—Moser, Patterson & Sheridan, L.L.P.

(57) ABSTRACT

An apparatus and method of controlling the flow of hydrocarbons into and/or out of a string of tubing disposed in a wellbore. In one embodiment, the apparatus comprises a tubular member having at least one aperture formed in a wall thereof and a sleeve disposed radially outward of the tubular member. The sleeve is selectively movable between a first position and a second position to control the flow between the outside and the inside of the tubular member. In one aspect, the apparatus further comprises a biasing member disposed adjacent the sleeve and adapted to apply a force against the sleeve in an axial direction and further comprises a piston adapted to receive a hydraulic pressure to move the sleeve against the force of the biasing member. In another aspect, the apparatus further comprises a electromechanical device adapted to selectively move the sleeve between the first position and the second position and further comprises a control line adapted to conduct an electrical current. In another embodiment, the apparatus comprises a tubular member having at least one aperture formed therein and a fixed ring and a rotatable ring disposed radially outward of the tubular member. In still another embodiment, the apparatus comprises a plurality of annular ribs having an inner surface, at least one support rod disposed along the inner surface of the annular ribs, and at least one control line disposed along the inner surface of the annular ribs.

83 Claims, 11 Drawing Sheets

U.S. PATENT DOCUMENTS

| | | | | | |
|---|---|---|---|---|---|
| 4,373,582 | A | | 2/1983 | Bednar et al. | 166/65 R |
| 4,936,386 | A | | 6/1990 | Colangelo | 166/292 |
| 5,183,114 | A | * | 2/1993 | Mashaw et al. | 166/319 |
| 5,240,074 | A | | 8/1993 | Peavy et al. | 166/286 |
| 5,372,193 | A | | 12/1994 | French | 166/250 |
| 5,465,787 | A | | 11/1995 | Roth | 166/66.4 |
| 5,609,204 | A | | 3/1997 | Rebardi et al. | 166/51 |
| 5,662,165 | A | | 9/1997 | Tubel et al. | 166/250.01 |
| 5,803,179 | A | | 9/1998 | Echols et al. | 166/370 |
| 5,896,928 | A | | 4/1999 | Coon | 166/373 |
| 5,927,401 | A | | 7/1999 | Morris et al. | 166/64 |
| 6,247,536 | B1 | * | 6/2001 | Leismer et al. | 166/305.1 |
| 6,286,594 | B1 | * | 9/2001 | French | 166/151 |
| 6,302,208 | B1 | * | 10/2001 | Walker et al. | 166/278 |
| 6,325,150 | B1 | * | 12/2001 | Rayssiguier | 166/334.4 |
| 6,371,210 | B1 | | 4/2002 | Bode et al. | 166/370 |

* cited by examiner

FLOW CONTROL APPARATUS FOR USE IN A WELLBORE

BACKGROUND OF THE INVENTION

1. Field of the Invention

The present invention generally relates to an apparatus and a method of controlling the flow of hydrocarbons into and/or out of a string of tubing disposed in a wellbore. More particularly, the invention relates to an apparatus and a method of controlling the flow of hydrocarbons into a string of tubing that can be regulated remotely.

2. Description of the Related Art

FIG. 1 shows a cross-sectional view of a typical hydrocarbon well 10. The well 10 includes a vertical wellbore 12 and, thereafter, using some means of directional drilling like a diverter, a horizontal wellbore 14. The horizontal wellbore 14 is used to more completely and effectively reached formations bearing oil or other hydrocarbons. In FIG. 1, the vertical wellbore 12 has a casing 16 disposed therein while the horizontal wellbore 14 has no casing disposed therein.

After the wellbore 12 is formed and lined with casing 16, a string of production tubing 18 is run into the well 10 to provide a pathway for hydrocarbons to the surface of the well 10. The well 10 oftentimes has multiple hydrocarbon bearing formations, such as oil bearing formations 20, 21, 22 and/or gas bearing formations 24. Typically, packers 26 are used to isolate one formation from another. The production tubing 18 includes sections of wellscreen 28 comprising a perforated inner pipe (not shown) surrounded by a screen. The purpose of the wellscreen is to allow inflow of hydrocarbons into the production tubing 18 while blocking the flow of unwanted material. To recover hydrocarbons from a formation where there is casing 16 disposed in the wellbore, such as at formations 20 and 21, perforations 30 are formed in the casing 16 and in the formation to allow the hydrocarbons to enter the wellscreen 28 through the casing 16.

In open hole wellbores, to prevent the collapse of the formation around the wellscreen 28, a gravel packing operation is performed. Gravel packing involves filling the annular area 32 between the wellscreen 28 and the wellbore 12, 14 with sized particles having a large enough particle size such that the fluid will flow through the sized particles and into the wellscreen 28. The sized particles also act as an additional filtering layer along with the wellscreen 28.

FIG. 2 shows a cross-section view of a typical gravel packing operation in a horizontal wellbore 14. The sized particles are pumped at high pressures down the tubing 18 as a slurry 34 of sand, gravel, and liquid. The slurry 34 is directed into the annular area 32 by a cross-over tool 36. A second tubing (not shown) is run into the inner diameter of the production tubing 18 in order to block the apertures of the perforated inner pipe of the wellscreen 28. The second tubing prevents the liquid of the slurry 34 from flowing into the wellscreen 28. Thus, the slurry can be directed along the entire length of the wellscreen 28. As the slurry 34 fills the annular area 32, the liquid portion is circulated back to the surface of the well through tubing 18, causing the sand/gravel to become tightly packed around the wellscreen 28.

Referring back to FIG. 1, because the hydrocarbon bearing formations can be hundreds of feet across, horizontal wellbores 14 are sometimes equipped with long sections of wellscreen 28. One problem with the use of these long sections of wellscreen 28 is that a higher fluid flow into the wellscreen 28 may occur at a heel 40 of the wellscreen 28 than at a toe 42 of the wellscreen 28. Over time, this may result in a "coning" effect in which fluid in the formation tends to migrate toward the heel 40 of the wellscreen 28, decreasing the efficiency of production over the length of the wellscreen 28. The "conning" effect is illustrated by a perforated line 44 which shows that water from a formation bearing water 46 may be pulled through the wellscreen 28 and into the tubing 18. The production of water can be detrimental to wellbore operations as it decreases the production of oil and must be separated and disposed of at the surface of the well 10.

In an attempt to address this problem, various potential solutions have been developed. One example is a device which incorporates a helical channel as a restrictor element in the inflow control mechanism of the device. The helical channel surrounds the inner bore of the device and restricts fluid to impose a more equal distribution of fluid along the entire horizontal wellbore. However, such an apparatus can only be adjusted at the well surface and thereafter, cannot be re-adjusted to account for dynamic changes in fluid pressure once the device is inserted into a wellbore. Therefore, an operator must make assumptions as to the well conditions and pressure differentials that will be encountered in the reservoir and preset the helical channel tolerances according to the assumptions. Erroneous data used to predict conditions and changes in the fluid dynamics during downhole use can render the device ineffective.

In another attempt to address this problem, one method injects gas from a separate wellbore to urge the oil in the formation in the direction of the production wellbore. However, the injection gas itself tends to enter parts of the production wellbore as the oil from the formation is depleted. In these instances, the gas is drawn to the heel of the horizontal wellbore by the same pressure differential acting upon the oil. Producing injection gas in a hydrocarbon well is undesirable and it would be advantageous to prevent the migration of injection gas into the wellbore.

In still another attempt to address this problem, a self-adjusting flow control apparatus has been utilized. The flow control apparatus self-adjusts based upon the pressure in the annular space in the wellbore. The flow control apparatus, however, cannot be selectively adjusted in a closed or open position remotely from the surface of the well.

Therefore there is a need for an apparatus and a method which controls the flow of fluid into a wellbore. There is a further need for an apparatus and method which controls the flow of fluid into a production tubing string which may be remotely regulated from the surface of the well while the apparatus is in use.

SUMMARY OF THE INVENTION

The present invention generally relates to an apparatus and a method of controlling the flow of hydrocarbons into and/or out of a string of tubing disposed in a wellbore. More particularly, the invention relates to a remotely regulatable apparatus and a method of controlling the flow of hydrocarbons into a string of tubing.

In one embodiment, the apparatus comprises a tubular member having at least one aperture formed in a wall thereof. The aperture provides fluid communication between an outside and an inside of the tubular member. A sleeve is disposed radially outward of the tubular member to selectively restrict the flow of fluid through the aperture. The sleeve is selectively movable between a first position and a second position to control a flow of fluid between the outside and the inside of the tubular member. The apparatus further comprises a movement imparting member for imparting movement to the sleeve.

In another embodiment, the apparatus comprises a tubular member having at least one aperture formed in a wall thereof. The aperture provides fluid communication between an outside and an inside of the tubular member. A sleeve is disposed radially outward of the tubular member. The sleeve is selectively movable between a first position and a second position to control the flow of fluid between the outside and the inside of the tubular member. The apparatus further comprises a electromechanical device adapted to impart movement to the sleeve and further comprises a control line adapted to supply an electrical current to the device from a remote location.

In still another embodiment, the apparatus comprises a tubular member having at least one aperture formed in a wall thereof. The aperture provides fluid communication between an outside and an inside of the tubular member. A fixed ring and a rotatable ring are disposed radially outward of the tubular member. The fixed ring and the rotatable ring have voids formed therethrough. The rotatable ring is selectively movable to align the voids of the fixed ring and the rotatable ring to create a passage through the fixed ring and the rotatable ring. The apparatus further comprises a chamber in communication with the passage and the aperture of the tubular member and serves to allow the flow of fluid to and from the aperture of the tubular member.

In one embodiment, a wellscreen is provided having a plurality of annular ribs with an inner surface, at least one support rod disposed extending longitudinally along the inner surface of the annular ribs, and at least one control line also running longitudinally along the inner surface of the annular ribs.

In another embodiment, the method comprises running at least two flow control apparatuses on a string of tubing into a wellbore. Each flow control apparatus comprises a tubular member having at least one aperture formed in a wall thereof. The aperture provides fluid communication between an outside and an inside of the tubular member. Each flow control apparatus is adapted to be set in a first position or in a second position permit differing amounts of fluid to flow therethrough. The method further comprises setting each of the flow control apparatuses in the first position or the second position after run in.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
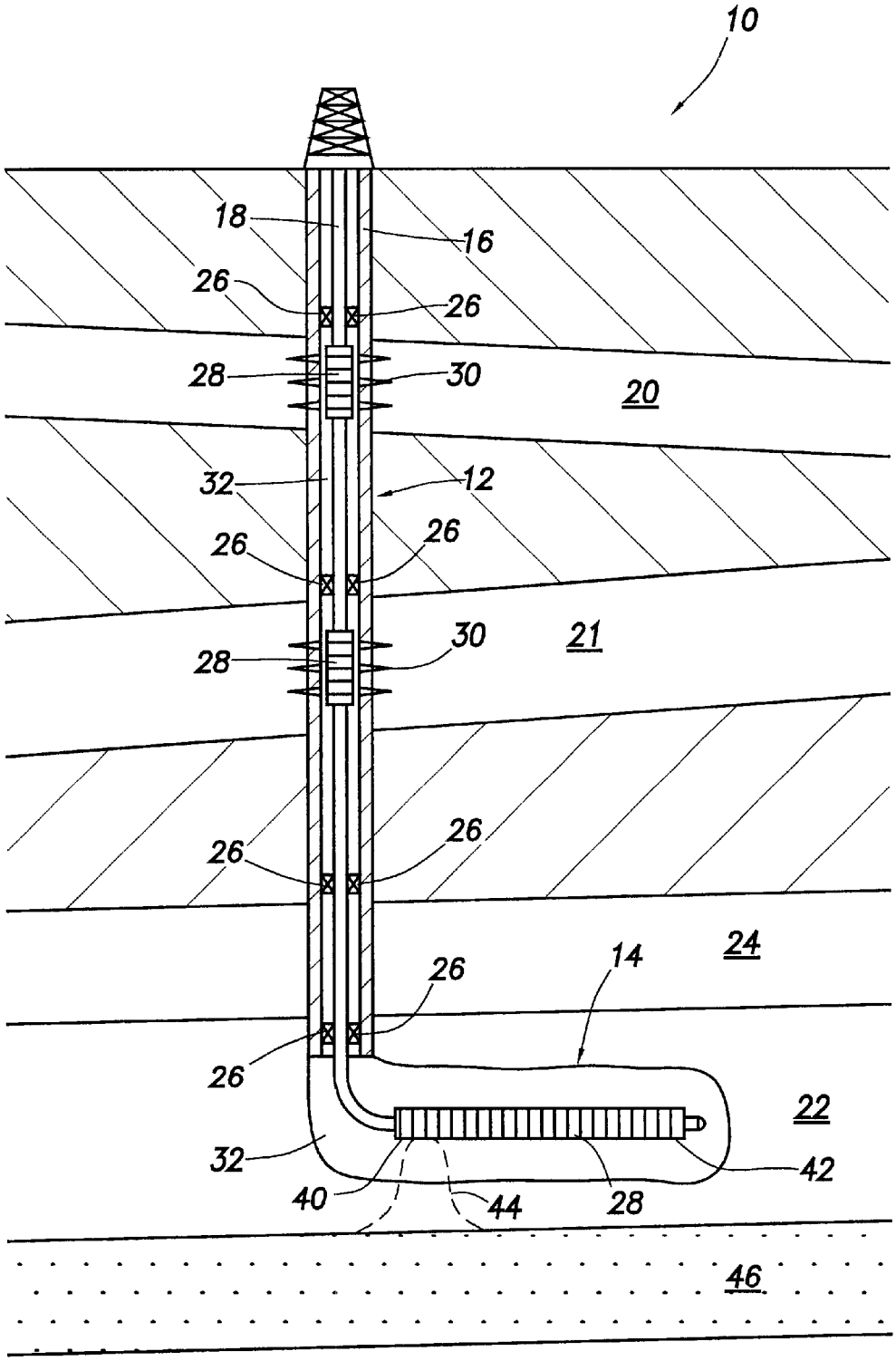
FIG. 1 is a cross-sectional view of a typical hydrocarbon well including a tubing with filter members disposed thereon.
Figure 2:
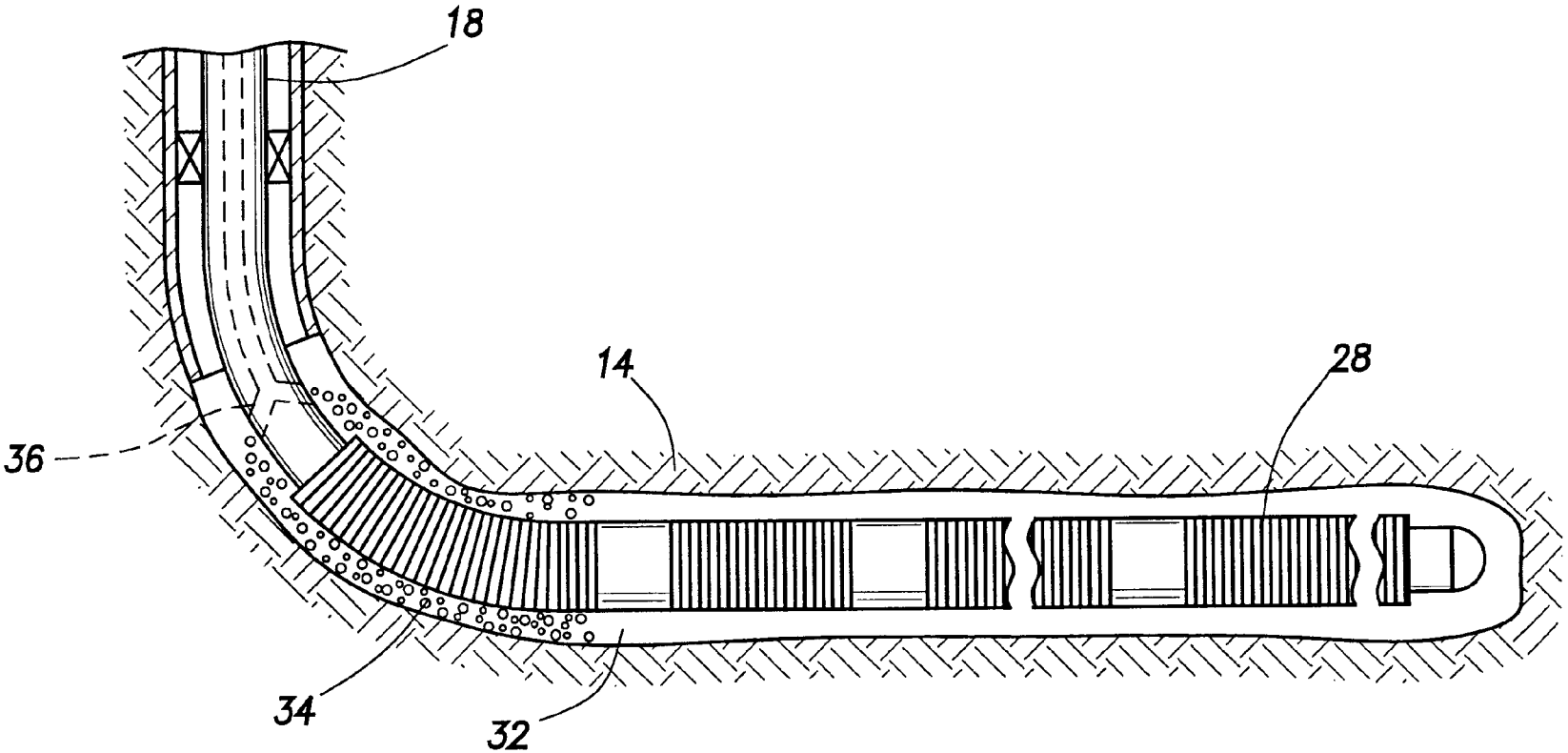
FIG. 2 shows a cross-section view of a typical gravel packing operation in a horizontal wellbore.
Figure 3:
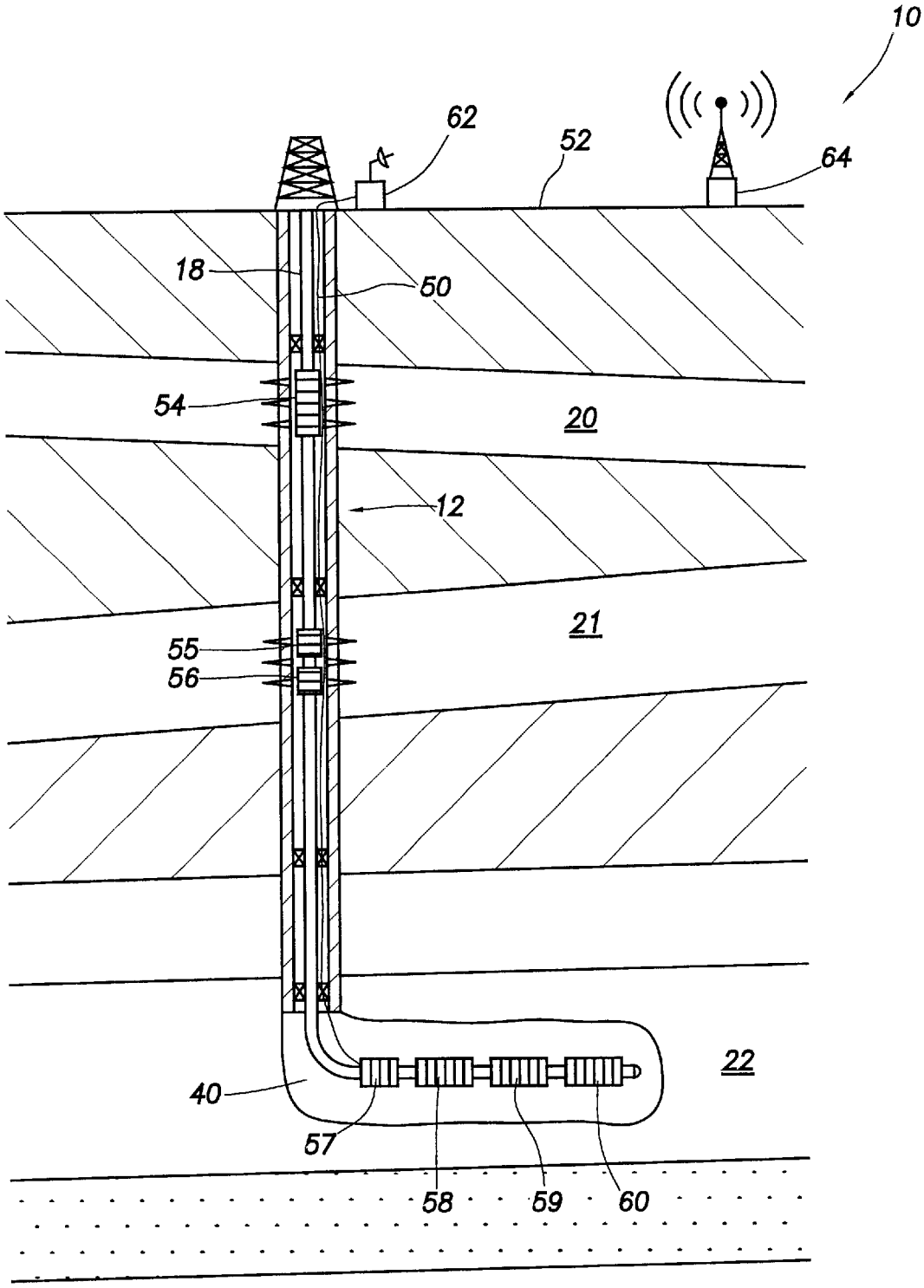
FIG. 3 is a cross-sectional view of a plurality of flow control apparatuses coupled to a string of tubing run into a wellbore.

FIG. 3 shows a cross-sectional view of one embodiment of a plurality of flow control apparatuses 54–60 coupled to a string of tubing 18 run in a wellbore. Included is at least one control line 50 which runs from the surface 52 to the flow control apparatuses 54–60. The control line 50 may be disposed on the outer surface of the tubing 18 by clamps (not shown). The clamps may be adapted to cover and to protect the control line 50 on the tubing 18 during run-in and operation in the well.

In one embodiment, each flow control apparatus comprises a tubular member (FIG. 4) having apertures formed in a wall thereof. The apertures provide fluid communication between an outside and an inside of the tubular member. Each flow control apparatus further comprises a screen disposed radially outward of the tubular member. The control line 50 is adapted to individually or collectively set each flow control apparatus 54–60 in a first position or a second position to control a flow of fluid between the outside and the inside of the tubular member. In the first position, a reduced amount of fluid is allowed to flow between the outside and the inside of the tubular member in comparison to the second position. For example, in the first position, the apertures are closed or partially closed to restrict flow of fluid therethrough into the tubing 18. In a second position, the apertures are open or partially open to increase flow of fluid therethrough into the tubing 18. Of course, the flow control apparatus may be adapted so that the flow control apparatus may be set in any position between the first position and the second position. In this manner, the flow of fluid into the wellbore at the location of the apertures is controlled.

The control line 50 is adapted to supply a hydraulic pressure, to supply an electrical current, or to supplying both a hydraulic pressure and an electrical current to set the flow control apparatuses 54–60, which is discussed in further detail below. Alternatively, the flow control apparatuses 54–60 may be adapted to be adjusted by a hydraulic pressure provided by a second tubular member (not shown), such as a coiled tubing, adapted to be disposed in the inner diameters of the tubular members of the flow control apparatuses 54–60. In addition, the flow control apparatuses 54–60 may be adapted to be adjusted by a hydraulic pressure applied to the annular space between the tubing 18 and the wellbore.

An operator at the surface 52 may set the flow control apparatuses individually or collectively in the first position, in the second position, or in position therebetween to control the flow of oil or other hydrocarbons through the flow control apparatuses 54–60 into the tubing 18. For example, an operator can set the flow control apparatus 57 in a first position and set the flow control apparatuses 58–60 in a second position to reduce the effect of "coning" near the heel 40 of the horizontal sections of the tubing 18. Additionally, the operator can choose to produce hydrocarbons from a certain formation by opening the apertures of the flow control apparatuses only at that formation. For example, the operator can set the flow control apparatuses 54, 57, 58, 59, and 60 in the first position and set the flow control apparatuses 55 and 56 in the second position in order to produce oil from formation 21. Furthermore, in one embodiment, there is no limitation to the number of times the flow control apparatus can be set between the first position and the second position. Of course, the flow control apparatus can be adapted so that the flow control apparatus can only be set once. In addition, the flow control apparatuses may be used to control the flow of fluids out of the tubing 18. For example, certain flow control apparatuses can be set in a second position in order to inject pressures into a particular formation.

In one embodiment, the control line 50 is coupled to a control panel 62 at the surface 52 which adjusts the flow control apparatuses 54–60 by operating the control line 50 through an automated process. The control panel 62 may be self-controlled, may be controlled by an operator at the surface 52, or may be controlled by an operator which sends commands to the control panel 62 through wireless or hard-line communications from a remote location 64, such as at an adjacent oil rig. Furthermore, the control panel 62 may be adapted to monitor conditions in the wellbore and may be adapted to send the readings of the conditions in the wellbore to the remote location, such as to an operator to help the operator to determine how to set the flow control devices 54–60.

FIGS. 4–11 are cross-sectional views of various embodiments of the apparatus of the present invention. For ease and clarity of illustration and description, the apparatus will be further described as if disposed in a horizontal position in horizontal wellbore. It is to be understood, however, that the apparatus may be disposed in a wellbore in any orientation, such as in a vertical orientation or in a horizontal orientation. Furthermore, the apparatus may be disposed in any tubular structure, such as in a cased wellbore or an uncased wellbore.

Figure 4:
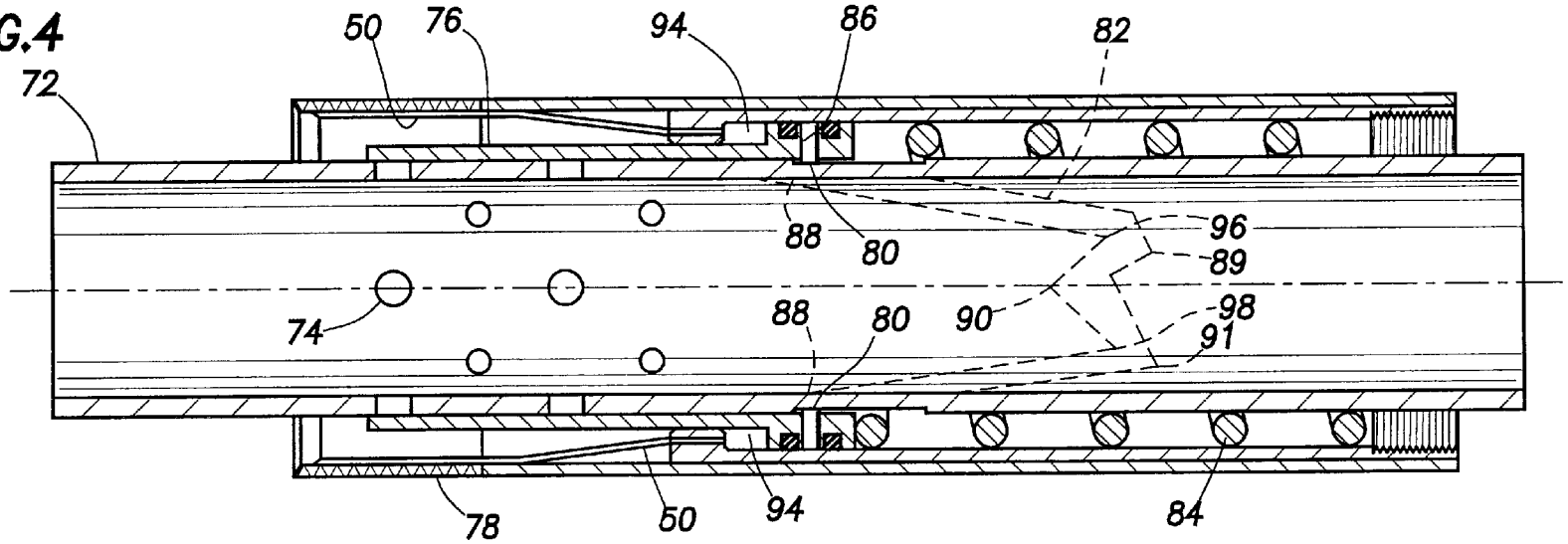
FIGS. 4 and 5 are cross-sectional views of one embodiment of a flow control apparatus shown in two different positions.
Figure 5:
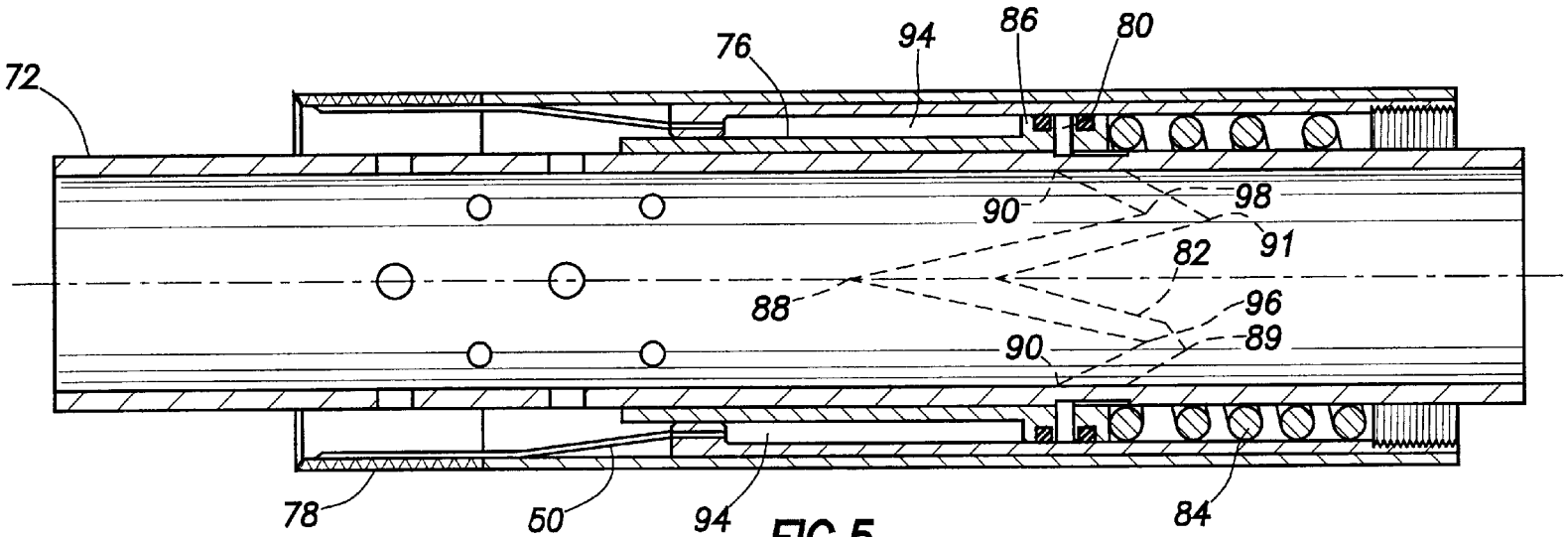

FIGS. 4 and 5 show a cross-sectional view of one embodiment of a flow control apparatuses which is hydraulically actuated. The flow control apparatus includes a tubular member 72 having apertures 74 formed therein for flow of fluid therethrough between the outside of the tubular member 72 and the inside or the inner diameter of the tubular member 72. The apertures 74 may be any shape, such as in the shape of a slot or a round hole. A slidable sleeve 76 is disposed radially outward of the tubular member 72 and is selectively movable to cover or to uncover the apertures 74 of the tubular member 72. Alternatively, the slidable sleeve 76 may itself have apertures which align or misalign with the apertures 74 of the tubular member 72 to control flow of fluids therethrough. A screen 78 may be disposed radially outward of the sleeve 76 to block the flow of unwanted material into the apertures 74 of the tubular member 72.

The sleeve 76 covers or uncovers the apertures 74 by being positioned between a first position and a second position. In the first position, as shown in FIG. 4, the sleeve 76 covers at least a portion of the apertures 74 of the tubular member 72 to partially or fully restrict inflow of fluid into the apparatus. In the second position, as shown in FIG. 5, the sleeve 76 exposes at least a portion of the apertures 74 of the tubular member 72 to partially or fully allow inflow of fluid into the apparatus. The flow control apparatus may be designed whereby the sleeve 76 assumes any number of positions, covering and/or exposing various numbers of apertures 74 of the tubular member.

In the embodiment of FIGS. 4 and 5, a pin 80 or protrusion is inwardly disposed on the sleeve 76 and is adapted to travel along a slot 82 or groove formed on the outer surface of the tubular member 72. A spring or another biasing member 84 disposed adjacent the sleeve 76 pushes or biases the sleeve 76 to be in either the first position or the second position. When the sleeve 76 is in the first position as shown in FIG. 4, the pin 80 is positioned at location 88 on the slot 82. When the sleeve 76 is in the second position as shown in FIG. 5, the pin 80 is positioned at location 90 on the slot 82. It is to be understood that the slot 82 may be shaped in any number of different patterns so long as it is operable with a pin to move the sleeve axially and/or rotationally. It is to be further understood that the pin, sleeve, and piston may be separate, integrated, and/or unitary pieces.

A hydraulic pressure is utilized to move the sleeve 76 between the first position and the second position. The control line 50 is adapted to supply a hydraulic pressure to a piston chamber 94 housing a piston 86 coupled to the sleeve 76. When the hydraulic pressure supplied to the piston chamber 94 against the surface of piston 86 is greater than the force of the biasing member 84, the piston 86 moves and consequently the sleeve 78 moves.

To move the sleeve from the first position to the second position, a hydraulic pressure is supplied by the control line 50 to the piston chamber 94 to move the pin from location 88 on the slot 82 to location 89. Thereafter, the hydraulic pressure can be released. Because location 89 is "below" tip 96 of the slot 82, the protrusion moves to location 90 under the force of the biasing member 84 and, thus, the sleeve 76 moves to the second position.

To move the sleeve 76 from the second position to the first position, a hydraulic pressure is supplied by the control line 50 to the piston chamber 94 to move the pin 80 from location 90 on the slot to location 91. Thereafter, the hydraulic pressure can again be released. Because location 91 is "below" tip 98, the protrusion moves to location 88 under the force of the biasing member 84 and, thus, the sleeve 76 moves to the first position.

Other embodiments of a flow control apparatus which are hydraulically actuated may be utilized without departing from the spirit of the invention. For example, the pin may be coupled to the outer surface of the tubular member while the slot is formed on the inner surface of the sleeve. There may be a plurality of control lines 50 coupled to the piston chamber 94 in which one of the control line supplies a fluid while another control line returns the fluid.

Figure 6:
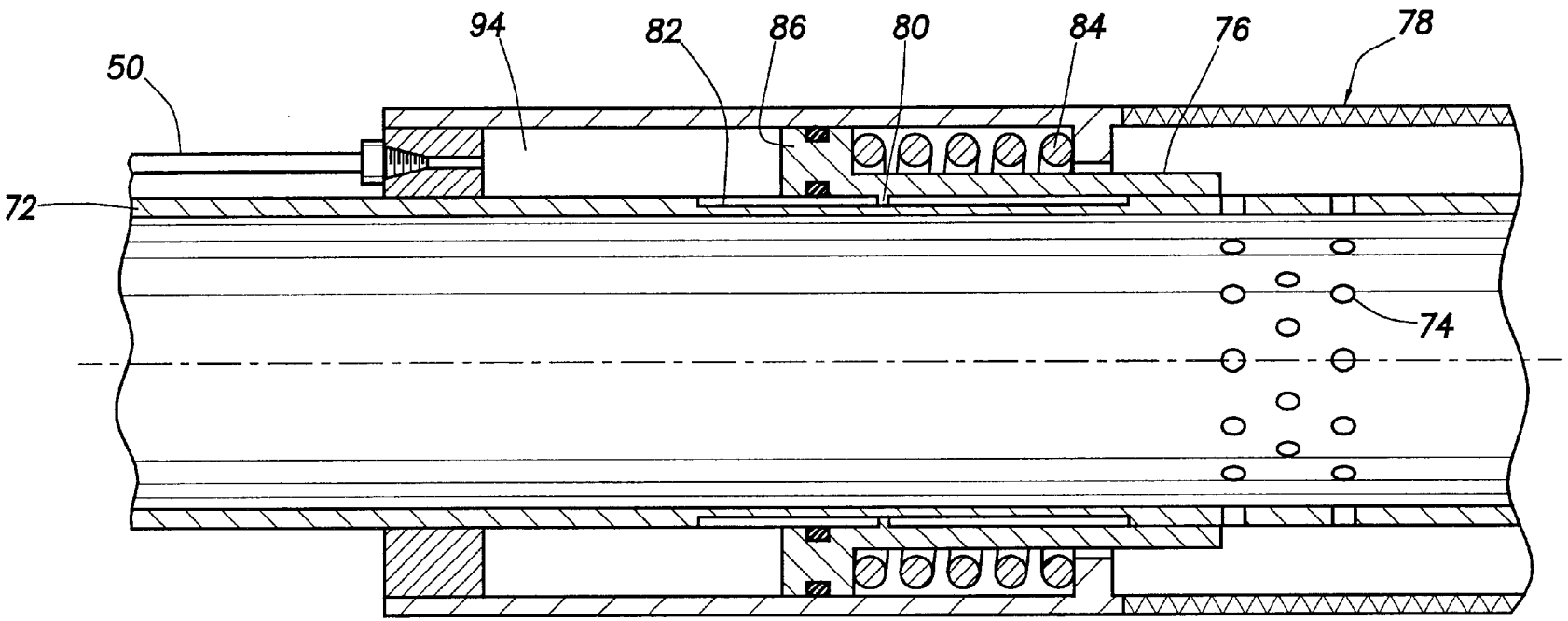
FIG. 6 is a cross-sectional view of another embodiment of a flow control apparatus which is hydraulically actuatable.

FIG. 6 shows a cross-sectional view of another embodiment of a flow control apparatus which is hydraulically actuated. Specifically, the arrangement of the screen 78, control line 50, slidable sleeve 76, and apertures 74 are different from the previous embodiments. The control line 50 supplies a hydraulic pressure to piston 86 to move the sleeve 76 to cover or uncover the apertures 74, such as between a first position and a second position. The apparatus may further include a slot (not shown) on the outer surface of the tubular member 72 to position the sleeve 76 in a first position or a second position to control the flow of fluid into the apparatus.

Figure 7:
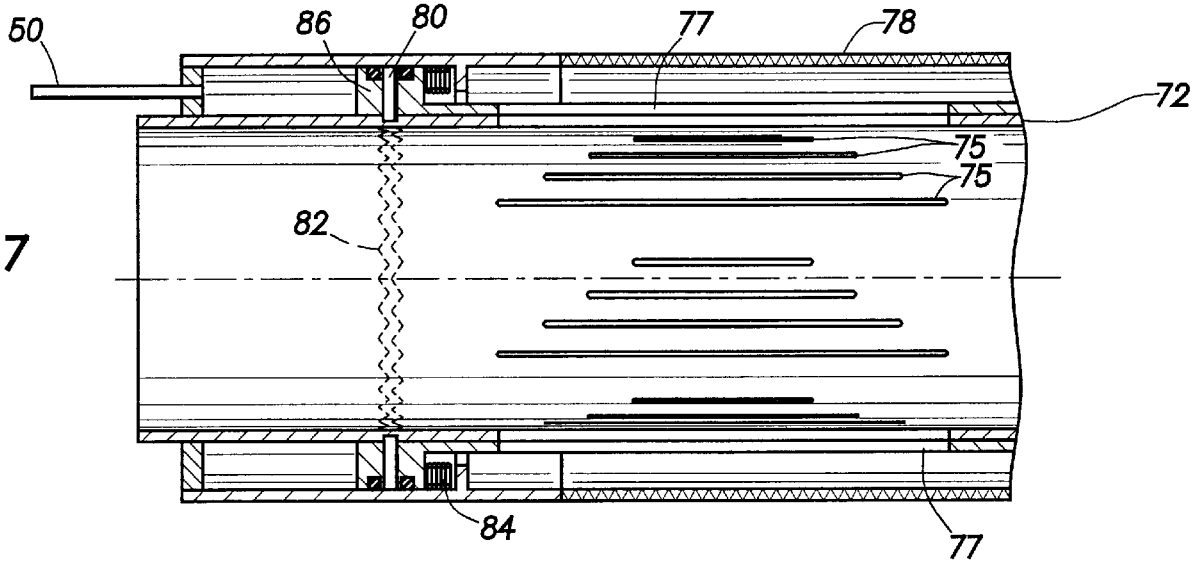
FIG. 7 is a cross-sectional view of still another embodiment of a flow control apparatus which is hydraulically actuatable.

FIG. 7 shows a cross-sectional view of another embodiment of a flow control apparatus which is hydraulically actuated. In this embodiment, the tubular member 72 has apertures 75 of varying size formed therethrough while the sleeve has apertures 77 formed therethrough. The sleeve 76 may be rotated by hydraulic pressure supplied by the control line 50 to piston 86 to move the sleeve 76 to cover or uncover the apertures 75. Movement of the sleeve to a second position aligns an aperture 77 of the sleeve with a certain sized aperture 75 of the tubular member 72. Alternatively, movement to a first position will cover the apertures 75 of the tubular member 72 thereby restricting the flow of fluid into the apparatus. The sleeve 76 is coupled to a pin 80 which is adapted to travel in a slot 82 formed on the outer surface of the tubular member. The flow control apparatus is designed to permit rotation of the sleeve in a predetermined direction. Alternatively, the sleeve may have apertures of varying size which align or misalign with apertures of the tubular member.

Figure 8:
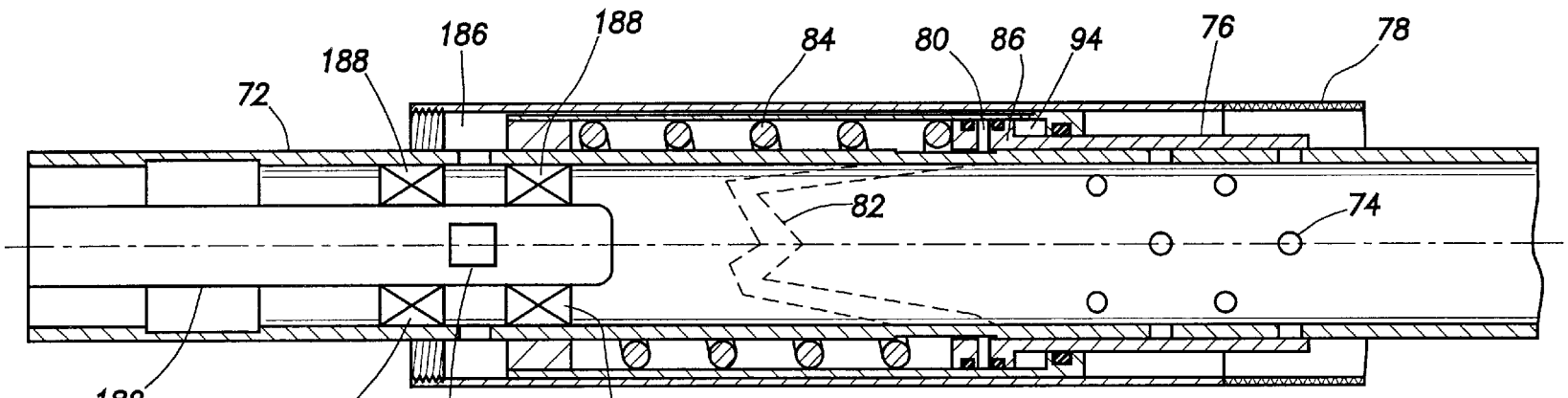
FIG. 8 is a cross-sectional view of one embodiment of a flow control apparatus which can be hydraulically actuated without the use of a hydraulic control line.

Other embodiments of a flow control apparatus which are hydraulically actuated may be utilized without the use of a control line. For example, FIG. 8 shows a cross-sectional view of one embodiment of a flow control apparatus which is actuated by a second tubular member 182 having an orifice 184 formed in a wall thereof. The second tubular member 182 is adapted to be disposed in the inner diameter of the tubular member 72 and adapted to communicate a hydraulic pressure through the orifice 184. Cups 188 disposed on the inner surface of the tubular member 72 direct the hydraulic pressure to a conduit 186 located through the tubular member 72. The hydraulic pressure flows through the conduit 186 to piston chamber 94 to provide a hydraulic pressure to piston 86 to move the sleeve 76 between a first position and a second position thereby controlling the flow of fluid into the apparatus. In one embodiment, the second tubular member 182 comprises coiled tubing.

In one embodiment, a method of actuating a plurality of flow control apparatuses with the second tubular member 182 as shown in FIG. 8 comprises running the second tubular member 182 to the flow control apparatus which is at a lowest point in a wellbore. The second tubular member 182 provides a hydraulic pressure to actuate that flow control apparatus. Thereafter, the second tubular member 182 is pulled up the wellbore to the next flow control apparatus to actuate that flow control apparatus and so on. In this manner, any number of flow control apparatus are remotely shifted using, for example, coiled tubing.

Figure 9:
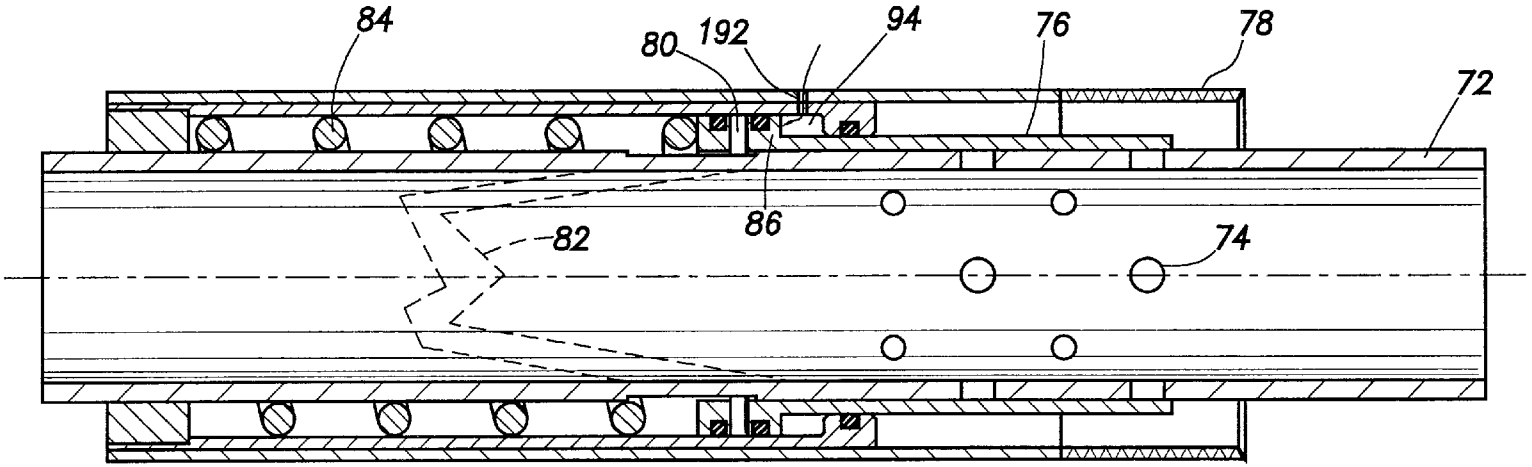
FIG. 9 is a cross-sectional view of another embodiment of a flow control apparatus which can be hydraulically actuated without the use of a hydraulic control line.

FIG. 9 shows a cross-sectional view of another embodiment of a flow control apparatus which is hydraulically actuated without the use of a control line. The flow control apparatus has an opening 192 disposed through the outer wall of the piston chamber 94. The opening 192 allows fluid to flow from an annular space between the flow control apparatus and the wellbore into the opening 192 and into the piston chamber 94. The flow control apparatus is adapted so that a hydraulic pressure flowed into the piston chamber against piston 86 moves the sleeve 76 to cover or uncover the apertures 74, such as between a first position and a second position. The apparatus of this embodiment can be shifted simply by increasing the pressure of the wellbore adjacent the opening 192.

Figure 10:
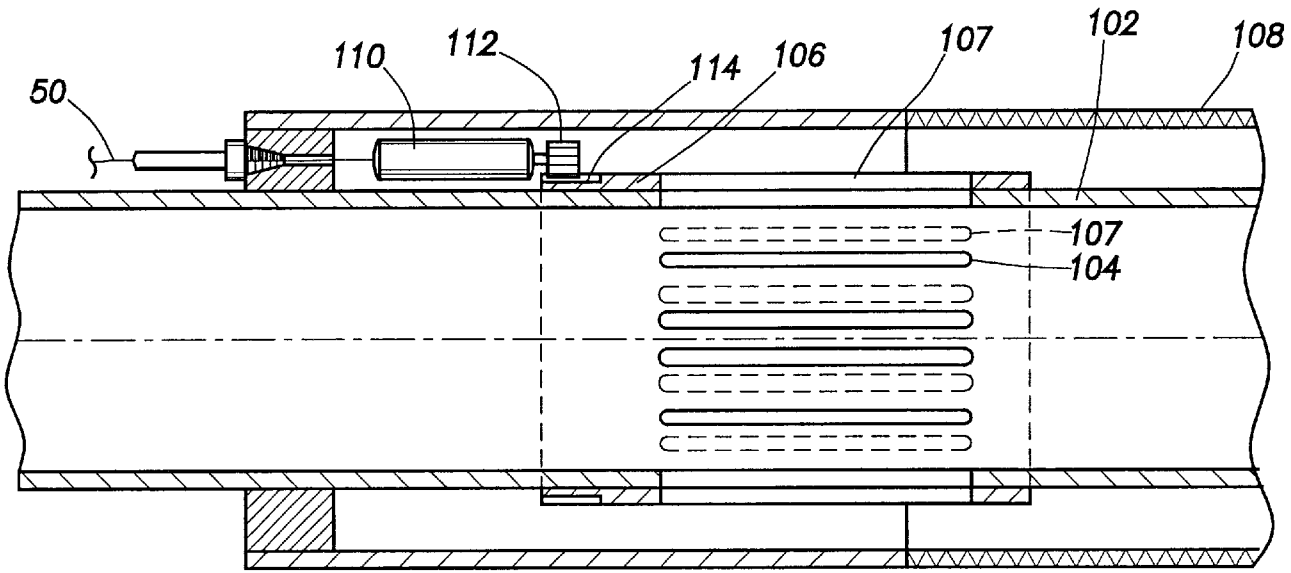
FIG. 10 is a cross-sectional view of one embodiment of a flow control apparatus which is actuated by electromechanical means.

FIG. 10 shows a cross-sectional view of one embodiment of one of an apparatus which is actuated by electromechanical means. The flow control apparatus includes a tubular member 102 having apertures 104 formed therein for flow of fluid therethrough. The apertures 104 may be any shape, such as in the shape of a slot or a round hole. A slidable sleeve 106 is disposed radially outward of the tubular member 102 and has at least one aperture 107 formed therein. The sleeve 106 is adapted to be selectively rotated so that the aperture 107 aligns, misaligns, or is positioned in any number of positions therebetween with the apertures 104 of the tubular member 102 to control flow of fluid therethrough. A screen 108 may be disposed radially outward of the sleeve 106 to block the flow of unwanted material into the apertures 104 of the tubular member 102.

A motor 110 is disposed proximate the sleeve 106 and is coupled to a gear 112. Teeth 114 are disposed on the outer surface of the sleeve 106 and are associated with the gear 112. A control line 50 provides electrical power to turn the gear 112 which causes the sleeve 106. In this manner, the aperture 107 of the sleeve 106 aligns, misaligns, or is positioned in any number of positions therebetween with the apertures 104 of the tubular member 106.

Figure 11:
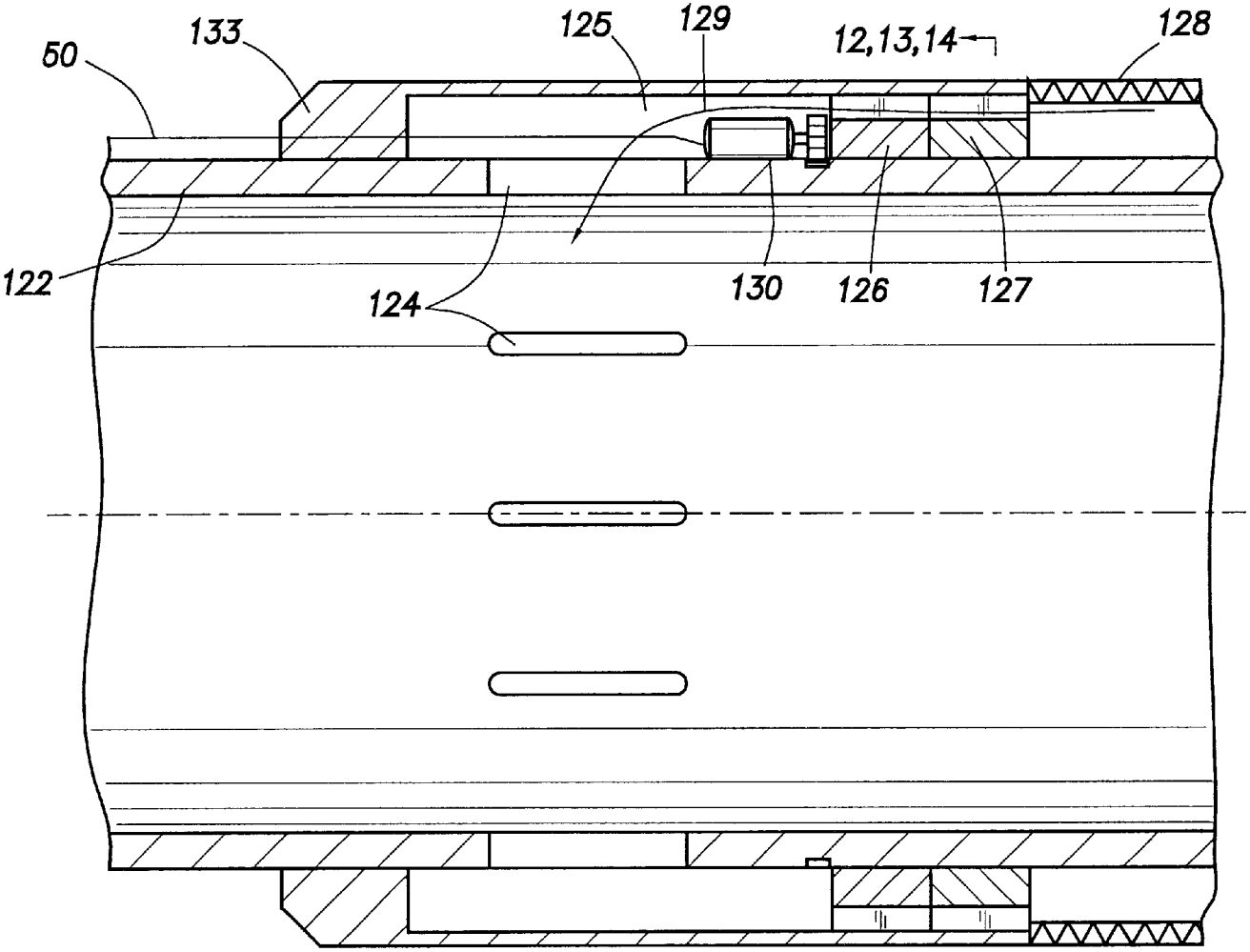
FIG. 11 is a cross-sectional view of another embodiment of a flow control apparatus which is actuated by electromechanical means.

FIG. 11 shows a cross-sectional view of another embodiment of a flow control apparatus which is actuated by electromechanical means. The flow control apparatus includes a tubular member 122 having apertures 124 formed in a wall thereof. The apertures 124 may be any shape, such as in the shape of a slot or a round hole. A chamber housing 133 is disposed radially outward of the tubular member 122 to define a chamber 125 in communication with the apertures 124. A rotatable ring 126 is disposed radially outward of the tubular member 122 adjacent to the chamber 125. A fixed ring 127 is disposed radially outward of the tubular member 122 adjacent to the rotatable ring 126. Both the rotatable ring 126 and the fixed ring 127 have voids or vias formed in an outer surface thereof. When the voids or vias overlap, a passage 129 is formed to allow fluid to flow pass the rotatable ring 126 and the fixed ring 127 into the chamber 125 and into the apertures 124 of the tubular member 122. The rotatable ring 126 may be rotated so that the voids of the rotatable ring 126 and the fixed ring 127 overlap in any number of amounts so that the flow of fluid can be controlled into the chamber 125. A screen 128 may be disposed radially outward of the tubular member 122 to block the flow of unwanted material into the apertures 124 of the tubular member 122.

Figure 12:
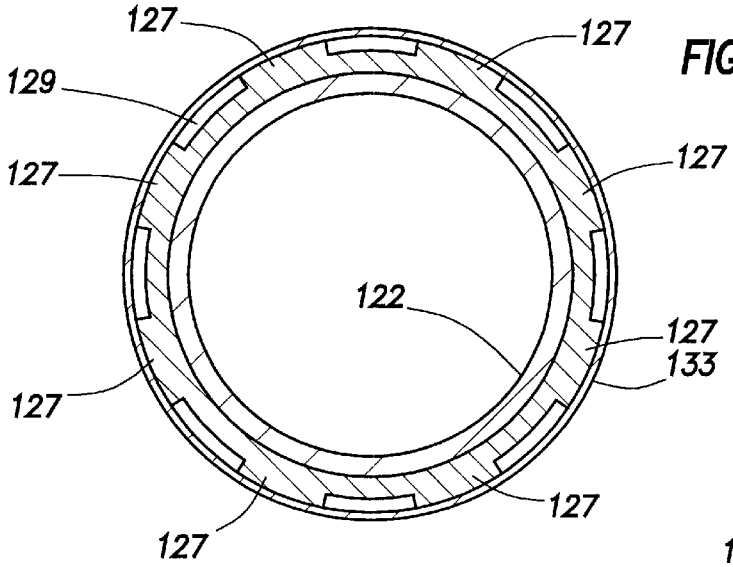
FIGS. 12–14 are side cross-sectional views of one embodiment of a rotatable ring and a fixed ring of the flow control apparatus of FIG. 11.
Figure 13:
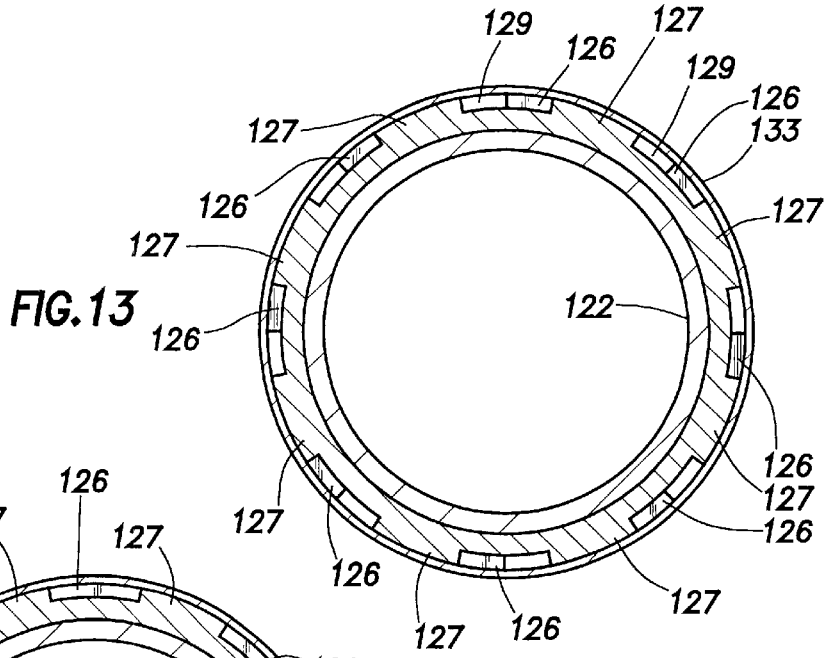
Figure 14:
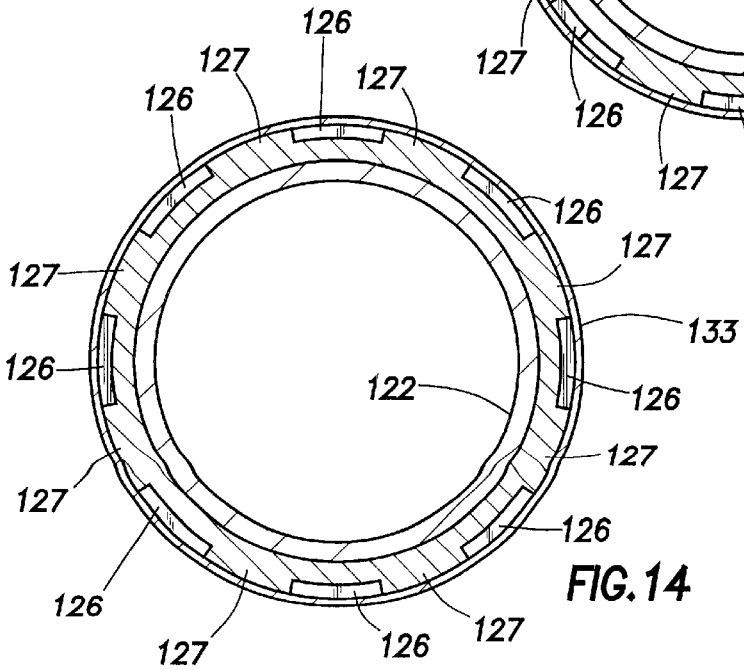

FIGS. 12–14 show side cross-sectional views of one embodiment of the rotatable ring 126 and the fixed ring 127 of the flow control apparatus of FIG. 11. Rotatable ring 126 and fixed ring 127 are in the shape of a gear having teeth sections and void sections. FIG. 12 illustrates a position wherein the voids of the rotatable ring (not shown) and the fixed ring 127 overlap forming a passage 129 to allow fluid to flow therethrough. FIG. 13 shows when the voids of the rotatable ring 126 and the fixed ring 127 partially over lap forming a passage 129 which is reduced in size from the passage illustrated in FIG. 12 but still allowing fluid to flow therethrough. FIG. 14 illustrates a position of the rings when the voids of the rotatable ring 126 and the fixed ring 127 are not aligned. In this position, there is no passage formed to allow the fluid to flow therethrough.

Referring again to FIG. 11, a motor 130 is disposed adjacent the rotatable ring 126 to rotate the rotatable ring 126. A control line 50 is disposed through the chamber housing 133 and coupled to the motor 130 to supply an electrical current to the motor. Alternatively, the position of the rotatable ring 126 and the fixed ring 127 could be manually set without the use of the motor 130 and the control line 50.

Figure 15:
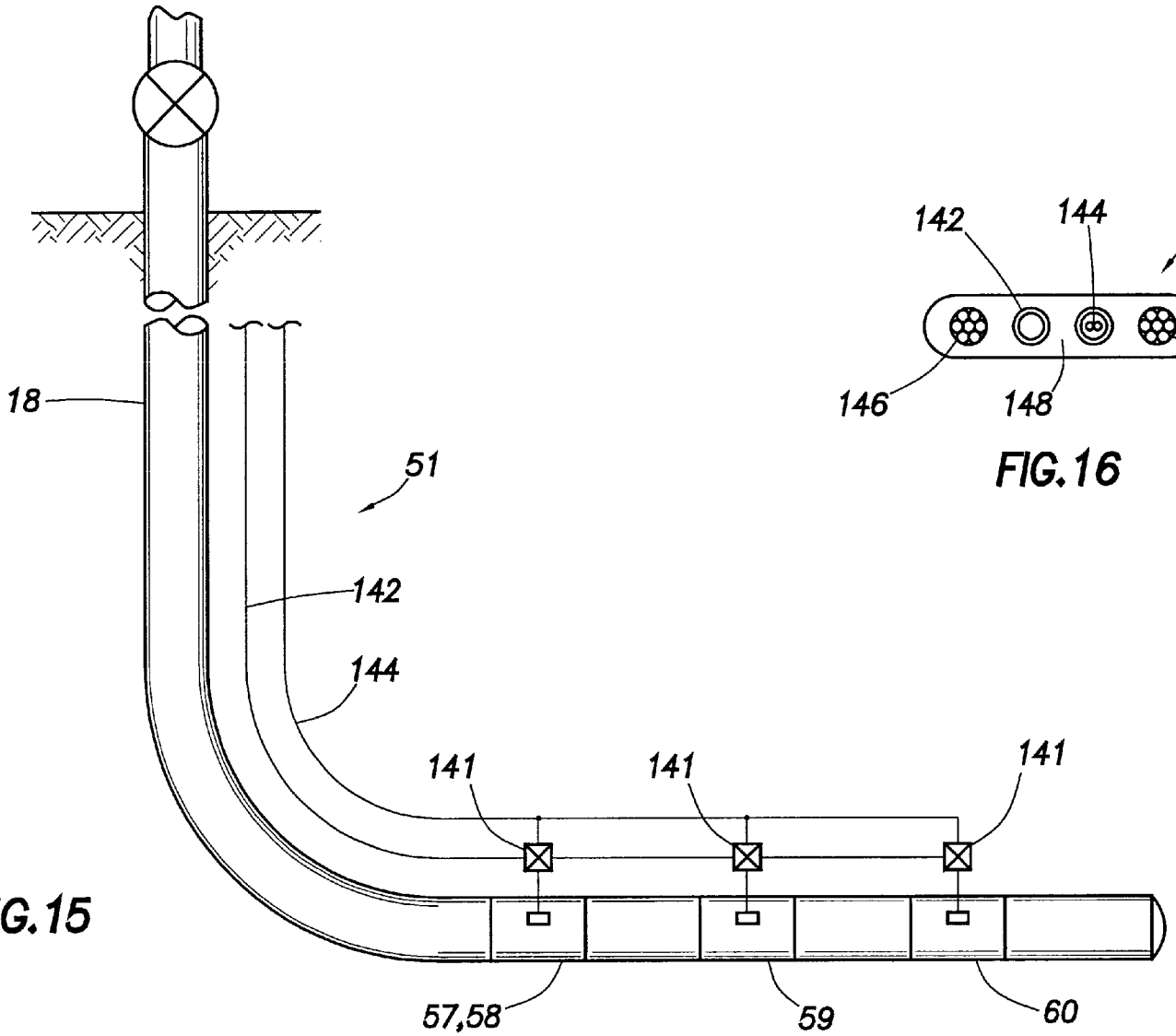
FIG. 15 is a schematic view of another embodiment of a flow control apparatus which is actuated by a combination of a hydraulic pressure and an electrical current.

FIG. 15 shows a schematic view of another embodiment of a flow control apparatus which is actuated by a combination of hydraulic pressure and electrical current. A control line 51 comprises a plurality of conduits in which one conduit is a hydraulic conduit 142 supplying a hydraulic pressure and one conduit is an electrical conduit 144 supplying an electrical current. The control line 51 runs along the tubing 18 to the flow control apparatuses 57–60 disposed at various locations in the wellbore. The hydraulic conduit is coupled to a solenoid valve 141 located at each flow control apparatus 57–60. In the preferred embodiment, the control line is supplied with a constant source of a hydraulic pressure. The electrical conduit is coupled to each solenoid valve 141 to supply an electrical current to open and to close the valve 141. When the valve 141 is open, a hydraulic pressure is supplied to the flow control device such as those flow control devices described in FIGS. 4–7 to permit or restrict flow of fluid into the flow control devices. In another embodiment, a single valve 141 is associated for a plurality of flow control devices. In this case, opening the single valve causes a hydraulic pressure to be supplied to the plurality of flow control devices. Of course, a plurality of control lines 50 may be used instead of control line 51 with a plurality of conduits.

Figure 16:
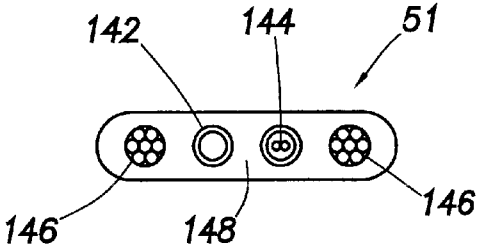
FIG. 16 is a cross-sectional view of one embodiment of a control line with a plurality of conduits.

FIG. 16 shows a cross-sectional view of one embodiment of a control line 51 with a plurality of conduits. The control line 51 includes a hydraulic conduit 142 which supplies a hydraulic pressure and includes an electrical conduit 144 which supplies an electrical current. Alternatively, a conduit may be adapted to be a fiber optic line or a communication line in order to communicate with gauges, devices, or other tools on the tubing string. The control line 51 may further include a cable 146 to add tensile strength to the control line 51. The deliver line 50 may also comprise a polymer 148 encapsulating the conduits and the cable.

Figure 17:
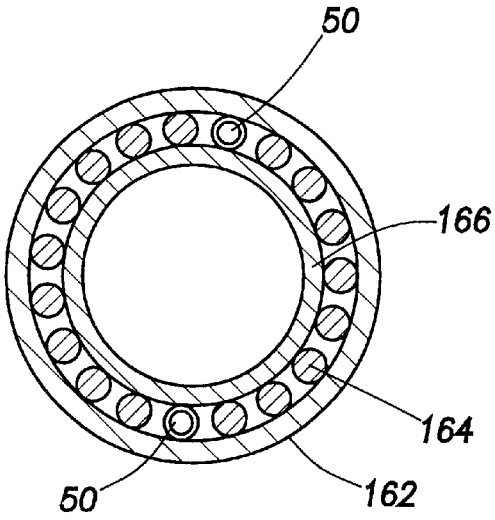
FIG. 17 is a side-cross-sectional view one embodiment of a control line integrated with a screen.

FIG. 17 shows a side cross-sectional view of one embodiment of an apparatus comprising the control line 50 (or control line 51) integrated with the screen. The arrangement provides a location for the control lines that saves space and protects the lines during run-in and operation. The control line 50 may supply a hydraulic pressure, an electrical current, or a combination thereof. In one embodiment, the screen comprises a plurality of annular ribs 162. A plurality of support rods 164 run longitudinally along the inner surface of the ribs 162. One or more control lines 50 also run longitudinally along the inner surface of the ribs 162. In one embodiment, a perforated tubular member 166 is disposed radially inward of the ribs 162 and the support rods 164. One method of constructing the screen is to shrink fit the ribs 162 over the support rods 164, control lines 50, and the tubular member 72, 102, 122. In one embodiment, when the integrated control line/screen apparatus is used with a flow control apparatus having a slidable sleeve or a rotatable ring, such as the flow control apparatuses described in FIGS. 4–7, 10 and 11, the support rods 164 are disposed axially away from the sliding sleeve or rotatable ring and do not interfere with the movement thereof. The integrated control line and screen may be used with any embodiment of the flow control apparatuses as shown in FIGS. 4–7, 10, 11, and 15 which require a control line.

In one aspect, an apparatus with a control line integrated into a screen as shown in FIG. 17 allows the use of a control line when harsh wellbore operations exist around a screen. For example, as discussed above, a gravel packing operation is performed around a screen in which the slurry is injected in the annular area between the screen and the wellbore at high pressures. If the control line were disposed on the outer surface of the screen, the gravel/sand of the high pressure slurry would abrade and eat away at the control line. Disposing the control line on the inner surface of the screen protects the control line from the high pressure gravel/sand slurry. In another example, the apparatus with a control line integrated to a screen allows one to perform a fracture packing operation around a control line. Pressures used in a fracture packing are typically even greater than that when gravel packing.

One method of utilizing a flow control device of the present invention comprises gravel packing a wellscreen having at least one of the flow control apparatuses as discussed above. The flow control apparatuses are arranged whereby the apertures thereof are closed to the flow of fluid therethrough from the annular space between the flow control apparatuses and the wellbore. A gravel/sand slurry is injected into the annular space without the loss of liquid into the tubular member of the flow control apparatus. In one aspect, the method allows uniform packing of the wellscreen without the use of an inner pipe disposed inside the tubular member.

Figure 18:
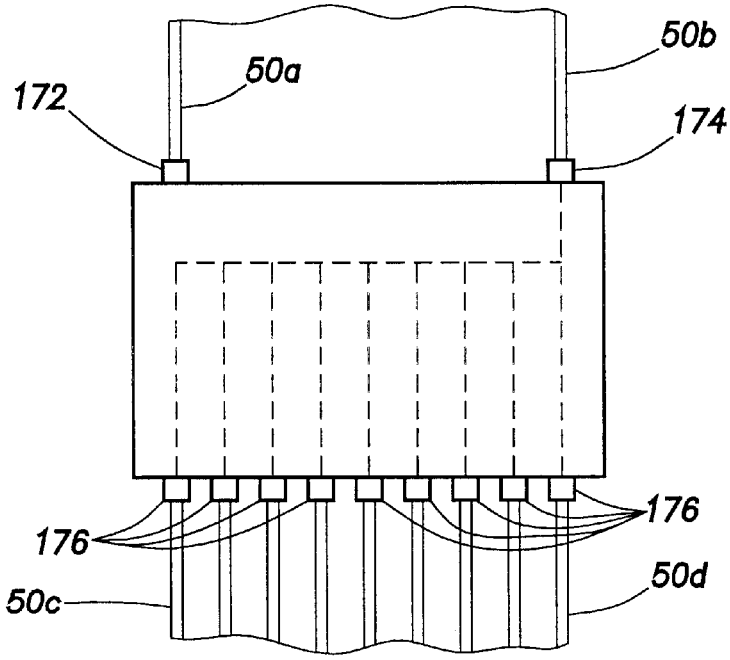
FIG. 18 is a schematic view of one embodiment of a control line manifold.

FIG. 18 shows a schematic view of one embodiment of a control line manifold. The control line manifold comprises one electrical inlet 172 and one hydraulic inlet 174 and comprises a plurality of hydraulic outlets 176. An electrical control line 50*a* (or electrical conduit 144) is coupled to the electrical inlet 172, and a hydraulic control line 50*b* (or hydraulic conduit 142) is coupled to the hydraulic inlet 174. Hydraulic control lines 50*n* are coupled to the hydraulic outlets 176 to supply a hydraulic pressure to a plurality of flow control apparatuses. The electrical control line 50*a* indexes or controls the control line manifold to communicate the hydraulic pressure from hydraulic control line 50*b* to certain hydraulic control lines 50*n*. In one aspect, the control line manifold allows the control over a plurality of flow control apparatuses while at the same time minimizing the number of control lines which are run to the surface. For example, a single electrical control line and a single hydraulic control line can be run to the surface from a control line manifold to control a plurality of flow control apparatus. In one aspect, the flow control manifold minimizes the number of control lines which must be run to the surface through an inflatable packer or series of inflatable packers. Of course, other embodiment of the control line manifold may be devised having a different number and different kinds of inlets and outlets.

The embodiments of the flow control apparatus as shown in FIGS. 4–14 may be used alone, in combination with the same embodiment, or in combination with different embodiments. Any embodiment of the flow control apparatus as shown in FIGS. 4–14 may be used as the flow control apparatuses 54–60 (FIG. 3) coupled to the string of tubing 18.

While foregoing is directed to the preferred embodiment of the present invention, other and further embodiments of the invention may be devised without departing from the basic scope thereof, and the scope thereof is determined by the claims that follow.

What is claimed is:

1. A flow control apparatus for use in wellbore operations, comprising:

a tubular member having at least one aperture formed in a wall thereof, the aperture providing fluid communication between the outside and the inside of the tubular member;

a slot formed on the outer surface of the tubular member;

a sleeve disposed radially outward of the tubular member, the sleeve being selectively movable between a first position and a second position to selectively control a flow of fluid between the outside and the inside of the tubular member;

a pin coupled to the sleeve and adapted to travel in the slot, wherein the pin and the slot govern movement of the sleeve with respect to the tubular member; and a biasing member disposed adjacent the sleeve and adapted to apply a force against the sleeve in an axial direction; and a piston surface formed on the sleeve, the piston surface adapted to receive a hydraulic pressure to move the sleeve against the force of the biasing member.

2. A remotely operable flow control apparatus for use in wellbore operations, comprising:

a tubular member having at least one aperture formed in a wall thereof, the aperture providing fluid communication between an outside and an inside of the tubular member;

a sleeve disposed radially outward of the tubular member, the sleeve being selectively movable between a first position and a second position to control a flow of fluid between the outside and the inside of the tubular member;

a movement imparting member adjacent the sleeve for imparting movement to the sleeve; and a pin and a slot adapted to govern movement of the sleeve with respect to the tubular member, the pin being adapted to travel in the slot.

3. The flow control apparatus of claim 2, wherein the pin is coupled to the sleeve and wherein the slot is formed on the outer surface of the tubular member.

4. The flow control apparatus of claim 2, wherein the pin is coupled to the outer surface of the tubular member and wherein the slot is formed on the inner surface of the sleeve.

5. The flow control apparatus of claim 2, further comprising a biasing member disposed adjacent the sleeve and adapted to apply a force against the sleeve in an axial direction, wherein the movement imparting member is adapted to move the sleeve against the force of the biasing member.

6. The flow control apparatus of claim 5, wherein the biasing member is a spring.

7. The flow control apparatus of claim 5, wherein the movement imparting member comprises a piston surface formed on the sleeve, the piston surface adapted to receive a hydraulic pressure to move the sleeve against the force of the biasing member.

8. The flow control apparatus of claim 2, wherein the movement imparting member comprises a piston surface formed on the sleeve, the piston surface adapted to receive a hydraulic pressure to move the sleeve.

9. The flow control apparatus of claim 8, wherein the movable sleeve is adapted to move between the first position and the second position as a result of the hydraulic pressure applied to the piston surface.

10. The flow control apparatus of claim 9, wherein the flow control apparatus is adapted to receive the hydraulic pressure supplied by a tubing disposable inside the tubular member.

11. The flow control apparatus of claim 10, wherein the tubing is coiled tubing.

12. The flow control apparatus of claim 8, further comprising a tubular screen disposed therearound.

13. The flow control apparatus of claim 12, further comprising a control line integrated with the tubular screen, the control line providing the hydraulic pressure to the piston surface.

14. The flow control apparatus of claim 2, wherein in the first position a reduced amount of fluid may flow between the outside and the inside of the tubular member in comparison to the second position.

15. The flow control apparatus of claim 2, wherein the sleeve has at least one aperture formed in a wall thereof, and wherein in the second position the at least one aperture of the sleeve at least partially aligns with the at least one aperture of the tubular member.

16. The flow control apparatus of claim 2, wherein the sleeve is movable axially between the first position and the second position.

17. The flow control apparatus of claim 9, wherein the flow control apparatus is adapted to receive the hydraulic pressure from an annular space between the flow control apparatus and the wellbore.

18. A remotely operable flow control apparatus for use in wellbore operations, comprising:

a tubular member having at least one aperture formed in a wall thereof, the aperture providing fluid communication between an outside and an inside of the tubular member;

a sleeve disposed radially outward of the tubular member, the sleeve being selectively movable between a first position and a second position to control a flow of fluid between the outside and the inside of the tubular member, wherein in the first position the sleeve covers at least a portion of the at least one aperture so that a reduced amount of fluid may flow between the outside and the inside of the tubular member in comparison to the second position; and a movement imparting member adjacent the sleeve for imparting movement to the sleeve.

19. The flow control apparatus of claim 18, further comprising a biasing member disposed adjacent the sleeve and adapted to apply a force against the sleeve in an axial direction, wherein the movement imparting member is adapted to move the sleeve against the force of the biasing member.

20. The flow control apparatus of claim 19, wherein the movement imparting member comprises a piston surface formed on the sleeve, the piston surface adapted to receive a hydraulic pressure to move the sleeve against the force of the biasing member.

21. The flow control apparatus of claim 18, wherein the movement imparting member comprises a piston surface formed on the sleeve, the piston surface adapted to receive a hydraulic pressure to move the sleeve.

22. The flow control apparatus of claim 21, wherein the movable sleeve is adapted to move between the first position and the second position as a result of the hydraulic pressure applied to the piston surface.

23. The flow control apparatus of claim 22, wherein the flow control apparatus is adapted to receive the hydraulic pressure supplied by a tubing disposable inside the tubular member.

24. The flow control apparatus of claim 22, wherein the flow control apparatus is adapted to receive the hydraulic pressure from an annular space between the flow control apparatus and the wellbore.

25. The flow control apparatus of claim 21, further comprising a tubular screen disposed therearound.

26. The flow control apparatus of claim 25, further comprising a control line integrated with the tubular screen, the control line providing the hydraulic pressure to the piston surface.

27. The flow control apparatus of claim 18, wherein the sleeve has at least one aperture formed in a wall thereof, and wherein in the second position the at least one aperture of the sleeve at least partially aligns with the at least one aperture of the tubular member.

28. The flow control apparatus of claim 18, wherein the sleeve is movable axially between the first position and the second position.

29. A remotely operable flow control apparatus for use in wellbore operations, comprising:

a tubular member having at least one aperture formed in a wall thereof, the aperture providing fluid communication between an outside and an inside of the tubular member;

a sleeve having a plurality of different sized apertures formed in a wall thereof and is disposed radially outward of the tubular member, the sleeve being selectively movable between a first position and a second position to control a flow of fluid between the outside and the inside of the tubular member, wherein in the second position one or more of the plurality of different sized apertures of the sleeve at least partially aligns with the at least one aperture of the tubular member; and a movement imparting member adjacent the sleeve for imparting movement to the sleeve.

30. The flow control apparatus of claim 29, further comprising a biasing member disposed adjacent the sleeve and adapted to apply a force against the sleeve in an axial direction, wherein the movement imparting member is adapted to move the sleeve against the force of the biasing member.

31. The flow control apparatus of claim 30, wherein the movement imparting member comprises a piston surface formed on the sleeve, the piston surface adapted to receive a hydraulic pressure to move the sleeve against the force of the biasing member.

32. The flow control apparatus of claim 29, wherein the movement imparting member comprises a piston surface formed on the sleeve, the piston surface adapted to receive a hydraulic pressure to move the sleeve.

33. The flow control apparatus of claim 32, wherein the movable sleeve is adapted to move between the first position and the second position as a result of the hydraulic pressure applied to the piston surface.

34. The flow control apparatus of claim 33, wherein the flow control apparatus is adapted to receive the hydraulic pressure supplied by a tubing disposable inside the tubular member.

35. The flow control apparatus of claim 33, wherein the flow control apparatus is adapted to receive the hydraulic pressure from an annular space between the flow control apparatus and the wellbore.

36. The flow control apparatus of claim 32, further comprising a tubular screen disposed therearound.

37. The flow control apparatus of claim 36, further comprising a control line integrated with the tubular screen, the control line providing the hydraulic pressure to the piston surface.

38. The flow control apparatus of claim 29, wherein in the first position a reduced amount of fluid may flow between the outside and the inside of the tubular member in comparison to the second position.

39. The flow control apparatus of claim 29, wherein the sleeve is movable axially between the first position and the second position.

40. A remotely operable flow control apparatus for use in wellbore operations, comprising:

a tubular member having a plurality of different sized apertures formed in a wall thereof, the apertures providing fluid communication between an outside and an inside of the tubular member;

a sleeve disposed radially outward of the tubular member, the sleeve being selectively movable between a first position and a second position to control a flow of fluid between the outside and the inside of the tubular member; and a movement imparting member adjacent the sleeve for imparting movement to the sleeve.

41. The flow control apparatus of claim 40, further comprising a biasing member disposed adjacent the sleeve and adapted to apply a force against the sleeve in an axial direction, wherein the movement imparting member is adapted to move the sleeve against the force of the biasing member.

42. The flow control apparatus of claim 41, wherein the movement imparting member comprises a piston surface formed on the sleeve, the piston surface adapted to receive a hydraulic pressure to move the sleeve against the force of the biasing member.

43. The flow control apparatus of claim 40, wherein the movement imparting member comprises a piston surface formed on the sleeve, the piston surface adapted to receive a hydraulic pressure to move the sleeve.

44. The flow control apparatus of claim 43, wherein the movable sleeve is adapted to move between the first position and the second position as a result of the hydraulic pressure applied to the piston surface.

45. The flow control apparatus of claim 44, wherein the flow control apparatus is adapted to receive the hydraulic pressure supplied by a tubing disposable inside the tubular member.

46. The flow control apparatus of claim 44, wherein the flow control apparatus is adapted to receive the hydraulic pressure from an annular space between the flow control apparatus and the wellbore.

47. The flow control apparatus of claim 43, further comprising a tubular screen disposed therearound.

48. The flow control apparatus of claim 4, further comprising a control line integrated with the tubular screen, the control line providing the hydraulic pressure to the piston surface.

49. The flow control apparatus of claim 40, wherein in the first position a reduced amount of fluid may flow between the outside and the inside of the tubular member in comparison to the second position.

50. The flow control apparatus of claim 40, wherein the sleeve has at least one aperture formed in a wall thereof, and wherein in the second position the at least one aperture of the sleeve at least partially aligns with one or more of the apertures of the tubular member.

51. The flow control apparatus of claim 40, wherein the sleeve is movable axially between the first position and the second position.

52. A remotely operable flow control apparatus for use in wellbore operations, comprising:

a tubular member having at least one aperture formed in a wall thereof, the aperture providing fluid communication between an outside and an inside of the tubular member;

a sleeve disposed radially outward of the tubular member, the sleeve being selectively movable rotationally between a first position and a second position to control a flow of fluid between the outside and the inside of the tubular member; and a movement imparting member adjacent the sleeve for imparting movement to the sleeve.

53. The flow control apparatus of claim 52, wherein the sleeve is further movable axially between the first position and the second position.

54. The flow control apparatus of claim 52, further comprising a biasing member disposed adjacent the sleeve and adapted to apply a force against the sleeve in an axial direction, wherein the movement imparting member is adapted to move the sleeve against the force of the biasing member.

55. The flow control apparatus of claim 54, wherein the movement imparting member comprises a piston surface formed on the sleeve, the piston surface adapted to receive a hydraulic pressure to move the sleeve against the force of the biasing member.

56. The flow control apparatus of claim 52, wherein the movement imparting member comprises a piston surface formed on the sleeve, the piston surface adapted to receive a hydraulic pressure to move the sleeve.

57. The flow control apparatus of claim 56, wherein the movable sleeve is adapted to move between the first position and the second position as a result of the hydraulic pressure applied to the piston surface.

58. The flow control apparatus of claim 57, wherein the flow control apparatus is adapted to receive the hydraulic pressure supplied by a tubing disposable inside the tubular member.

59. The flow control apparatus of claim 57, wherein the flow control apparatus is adapted to receive the hydraulic pressure from an annular space between the flow control apparatus and the wellbore.

60. The flow control apparatus of claim 56, further comprising a tubular screen disposed therearound.

61. The flow control apparatus of claim 60, further comprising a control line integrated with the tubular screen, the control line providing the hydraulic pressure to the piston surface.

62. The flow control apparatus of claim 52, wherein in the first position a reduced amount of fluid may flow between the outside and the inside of the tubular member in comparison to the second position.

63. The flow control apparatus of claim 52, wherein the sleeve has at least one aperture formed in a wall thereof, and wherein in the second position the at least one aperture of the sleeve at least partially aligns with the at least one aperture of the tubular member.

64. The flow control apparatus of claim 52, wherein the sleeve is rotationally movable between the first and the second positions prior to inserting the flow control apparatus into a wellbore.

65. A remotely operable flow control apparatus for use in wellbore operations, comprising:

a tubular member having at least one aperture formed in a wall thereof, the aperture providing fluid communication between an outside and an inside of the tubular member;

a sleeve disposed radially outward of the tubular member, the sleeve being selectively movable between a first position and a second position to control a flow of fluid between the outside and the inside of the tubular member;

a movement imparting member adjacent the sleeve for imparting movement to the sleeve, wherein the movement imparting member comprises a piston surface formed on the sleeve, the piston surface adapted to receive a hydraulic pressure to move the sleeve; and a control line adapted to remotely supply the hydraulic pressure, wherein the sleeve is adapted to move between the first position and the second position as a result of the hydraulic pressure applied to the piston surface.

66. The flow control apparatus of claim 65, further comprising a biasing member disposed adjacent the sleeve and adapted to apply a force against the sleeve in an axial direction, wherein the movement imparting member is adapted to move the sleeve against the force of the biasing member.

67. The flow control apparatus of claim 66, wherein the piston surface is adapted to receive the hydraulic pressure to move the sleeve against the force of the biasing member.

68. The flow control apparatus of claim 65, wherein in the first position a reduced amount of fluid may flow between the outside and the inside of the tubular member in comparison to the second position.

69. The flow control apparatus of claim 65, wherein the sleeve has at least one aperture formed in a wall thereof, and wherein in the second position the at least one aperture of the sleeve at least partially aligns with the at least one aperture of the tubular member.

70. The flow control apparatus of claim 65, wherein the sleeve is movable axially between the first position and the second position.

71. The flow control apparatus of claim 65, further comprising a tubular screen disposed therearound.

72. The flow control apparatus of claim 71, wherein the control line is integrated with the tubular screen.

73. A method of controlling flow in wellbore operations, comprising:

providing a tubular having at least one aperture formed in a wall thereof, a sleeve disposed radially outward of the tubular, a movement imparting member; and moving the sleeve rotationally from a first position that allows at least restricted fluid flow between an outside and an inside of the tubular member to a second position that allows fluid flow between the outside and the inside of the tubular member.

74. The method of claim 73, wherein the moving of the sleeve further comprises axial movement of the sleeve.

75. The method of claim 73, wherein the movement imparting member is an electromechanical device.

76. The method of claim 73, wherein the movement imparting member comprises a piston surface adapted to receive a hydraulic pressure to move the sleeve.

77. The method of claim 73, wherein moving the sleeve at least partially aligns at least an aperture in the sleeve with the at least one aperture in the tubular.

78. The method of claim 73, moving the sleeve uncovers at least a portion of the at least one aperture of the tubular.

79. The method of claim 73, wherein moving the sleeve aligns at least a void formed on the outer surface of the sleeve with a void formed on the outer surface of a fixed sleeve to create a fluid passage in communication with the at least one aperture in the tubular.

80. The method of claim 73, further including placing the tubular on a string of tubing and disposing the tubular proximate a heel of a wellbore.

81. The method of claim 80, wherein a second tubular is coupled to the string of tubing, the second tubular having at least one aperture formed in a wall thereof, a sleeve disposed radially outward of the tubular and a movement imparting member.

82. The method of claim 81, further including positioning the second tubular proximate a toe of the wellbore.

83. The method of claim 82, further including moving the sleeve on the tubular to the first position and moving the sleeve on the second tubular to the second position, thereby reducing the flow at the heel of the wellbore and increasing the flow at the toe of the wellbore.

* * * * *